US011199031B2

(12) United States Patent
Wirths

(10) Patent No.: US 11,199,031 B2
(45) Date of Patent: Dec. 14, 2021

(54) MOTOR VEHICLE LOCK ARRANGEMENT

(71) Applicant: Brose Schliesssysteme GmbH & Co. KG, Wuppertal (DE)

(72) Inventor: Rainer Wirths, Wuppertal (DE)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 1178 days.

(21) Appl. No.: 15/127,284

(22) PCT Filed: Mar. 18, 2015

(86) PCT No.: PCT/EP2015/055676

§ 371 (c)(1),
(2) Date: Sep. 19, 2016

(87) PCT Pub. No.: WO2015/144526

PCT Pub. Date: Oct. 1, 2015

(65) Prior Publication Data

US 2017/0130490 A1 May 11, 2017

(30) Foreign Application Priority Data

Mar. 22, 2014 (DE) ..... 10 2014 205 371.4

(51) Int. Cl.
*E05B 81/20* (2014.01)
*E05B 81/14* (2014.01)
(Continued)

(52) U.S. Cl.
CPC ..... *E05B 81/20* (2013.01); *E05B 81/04* (2013.01); *E05B 81/14* (2013.01); *E05B 81/22* (2013.01); *E05B 85/107* (2013.01); *E05B 81/06* (2013.01)

(58) Field of Classification Search
CPC ..... E05B 81/04; E05B 81/06; E05B 81/14; E05B 81/20; E05B 81/22; E05B 85/107;
(Continued)

(56) References Cited

U.S. PATENT DOCUMENTS 4,796,932 A * 1/1989 Tame ..... E05B 81/20 292/112
6,050,117 A * 4/2000 Weyerstall ..... E05B 77/26 70/277
(Continued)

FOREIGN PATENT DOCUMENTS

DE 19700887 7/1998
DE 19800803 A1 * 8/1998 ..... E05B 81/20
(Continued)

OTHER PUBLICATIONS

Machine Translation of JP 2005220664 A, 2020, pp. 1-19 (Year: 2020).*
(Continued)

*Primary Examiner* — Christine M Mills
(74) *Attorney, Agent, or Firm* — Pauly, DeVries Smith & Deffner LLC

(57) ABSTRACT

The disclosure relates to a motor vehicle lock arrangement for a closure element which is movably coupled to a motor vehicle body, wherein a motor vehicle lock is provided, which in the mounted state is arranged on the closure element or on the motor vehicle body. It is proposed that a servo drive is provided for exerting a driving force on the closure element in its opening direction, so that the closure element can be moved in a motorized positioning process from a closed position into a gap position, and in this way an engagement gap can be created between closure element and motor vehicle body.

17 Claims, 4 Drawing Sheets

(51) Int. Cl.

| | |
|---|---|
| ***E05B 81/22*** | (2014.01) |
| ***E05B 85/10*** | (2014.01) |
| ***E05B 81/04*** | (2014.01) |
| *E05B 81/06* | (2014.01) |

(58) Field of Classification Search
CPC ..... Y10S 292/23; Y10T 292/1082; Y10T 292/1047
USPC ..... 292/201, 216, DIG. 23
See application file for complete search history.

(56) References Cited

U.S. PATENT DOCUMENTS

| | | | | |
|---|---|---|---|---|
| 6,439,623 | B1 * | 8/2002 | Lohfeld | E05B 81/20 292/201 |
| 6,505,867 | B1 * | 1/2003 | Szablewski | E05B 81/20 292/201 |
| 7,244,213 | B2 * | 7/2007 | Gueler | E05F 15/603 292/199 |
| 7,380,844 | B2 * | 6/2008 | Berghahn | E05B 81/20 292/201 |
| 7,874,609 | B2 * | 1/2011 | Whinnery | E05B 81/20 292/110 |
| 8,303,003 | B2 | 11/2012 | Berghahn et al. | |
| 9,003,707 | B2 * | 4/2015 | Reddmann | E05B 81/20 49/278 |
| 10,087,671 | B2 * | 10/2018 | Linden | E05F 15/616 |
| 2018/0216366 | A1 * | 8/2018 | Nottebaum | E05B 83/24 |
| 2018/0230718 | A1 * | 8/2018 | Menke | E05B 63/244 |
| 2019/0376323 | A1 * | 12/2019 | Rosales | E05B 81/22 |
| 2020/0002996 | A1 * | 1/2020 | Wirths | E05B 81/20 |

FOREIGN PATENT DOCUMENTS

| | | | | |
|---|---|---|---|---|
| DE | 29812121 | | 12/1999 | |
| DE | 19835994 | | 2/2000 | |
| DE | 19841309 | | 3/2000 | |
| DE | 29624351 | | 8/2002 | |
| DE | 10123187 | | 11/2002 | |
| DE | 102011055506 | | 5/2013 | |
| DE | 102014119382 | A1 * | 6/2016 | E05B 81/14 |
| DE | 202016104563 | U1 * | 11/2017 | E05B 77/02 |
| DE | 102016118685 | A1 * | 4/2018 | E05B 81/20 |
| EP | 1191172 | | 3/2002 | |
| JP | 2004218295 | | 8/2004 | |
| JP | 2005220664 | | 8/2005 | |
| JP | 2005220664 | A * | 8/2005 | |

OTHER PUBLICATIONS

Machine Translation of DE 19800803 A1, 2020, pp. 1-30 (Year: 2020).*
German Search Report for Patent Application No. 102014205371.4 dated Mar. 5, 2015 (11 pages) No Translation Available.
Korean Office Action for Patent Application No. 10-2016-7029515 dated Nov. 20, 2018 (11 pages) English Translation only.
"International Search Report and Written Opinion," for PCT/EP2015/055676, dated Jun. 9, 2015 (10 pages), English translation.

* cited by examiner

MOTOR VEHICLE LOCK ARRANGEMENT

CROSS-REFERENCE TO RELATED APPLICATIONS

This application is a national stage application under 35 U.S.C. 371 of International Patent Application Serial No. PCT/EP2015/055676, entitled "Kraftfahrzeugschlossanordnung," filed Mar. 18, 2015, which claims priority from German Patent Application No. DE 10 2014 205 371.4, filed Mar. 22, 2014, the disclosures of which are incorporated herein by reference.

FIELD OF THE TECHNOLOGY

The disclosure relates to a motor vehicle lock arrangement, a closure element arrangement and a method for the operation of a motor vehicle lock arrangement.

BACKGROUND

The motor vehicle lock arrangement in question is fitted with a motor vehicle lock and with a striker, locking bolt, or the like and can be used in all kinds of closure elements of a motor vehicle. This includes, in particular, side doors, rear doors, tailgates, trunk hatches or engine hoods. These closure elements can also be designed basically as sliding doors.

The known motor vehicle lock arrangement (DE 296 24 351 U1), from which the invention starts out, comprises a motor vehicle lock with the closing elements "latch bolt" and "locking pawl", which interact with each other in the usual way. The latch bolt can be held by the locking pawl in a pre-closed position and a main closed position. A lifting up of the locking pawl results in releasing of the holding engagement, so that the latch bolt can swivel into its open position. For the motorized lifting of the locking pawl there is provided an auxiliary opening drive unit in the known motor vehicle lock arrangement.

Since the locking pawl in the known motor vehicle lock arrangement can be lifted up in motorized manner by means of the auxiliary opening drive unit, there is basically no need for an outer door handle for the opening of the closure element. For example, the motorized lifting of the locking pawl can be triggered by means of a radio key. Even so, the usual outer door handles are always used in combination with the known motor vehicle lock arrangement, namely, in order to provide an engagement surface for the hand of the user during the manual movement of the closure element. The realization of such outer door handles, which are arranged on the outer skin of the closure element, is aerodynamically disadvantageous, results in risks of injury in event of a crash, limits the design freedom, and entails considerable costs.

SUMMARY

The problem which the invention proposes to solve is to configure and further modify the known motor vehicle lock arrangement so that an optimized realization of an engagement surface for the user's hand is made possible with low costs.

The above problem is solved in a motor vehicle lock arrangement as described herein.

Essentially, the basic notion is that the motor vehicle lock arrangement, especially the motor vehicle lock, can be fitted with a servo drive, which produces a limited movement of the closure element in its opening direction. This makes it possible to create an engagement gap between closure element and motor vehicle body, which together with a corresponding hand engagement arrangement can form a replacement for a usual outer door handle arranged on the outer door skin.

Specifically, it is proposed that the motor vehicle lock arrangement, especially the motor vehicle lock, comprises a servo drive for exerting a driving force on the closure element in its opening direction, so that in the mounted state of the motor vehicle lock arrangement the closure element can be moved in a motorized positioning process from a closed position into a gap position, and in this way an engagement gap can be created between closure element and motor vehicle body.

With the proposed solution, the function of the outer door handle can be shifted into an area between the closure element and the motor vehicle body, which is only accessible from the outside when the closure element is in the gap position. For this, provision can be made of a hand engagement arrangement which is accessible from the outside through the engagement gap, as will be explained below. The term "outside" always means the outer region of the motor vehicle here. The hand engagement arrangement is in this sense accessible from the outer region of the motor vehicle.

In various embodiments, the servo drive has a dual function, namely, on the one hand the function of implementing the positioning process and on the other hand the function of implementing a pulling shut process. Such a pulling shut process is a comfort function, in which the closure element is moved in motorized manner against the door sealing force in its main closed position. This dual use of the servo drive is economical and at the same time it can be realized in a compact design.

In various embodiments, the pulling shut process and/or the positioning process is or are realized by a motorized movement of the latch bolt of the motor vehicle lock. In this way, the latch bolt can have a triple function, namely, the function of holding and releasing a striker or the like, the function of moving the closure element in the closing direction in the course of the pulling shut process, and the function of moving the closure element in the opening direction in the course of the positioning process. This, in turn, results in high cost efficiency as well as a very compact design.

According to various embodiments, a closure element arrangement with a closure element and a motor vehicle lock arrangement associated with the closure element according to the proposal is provided.

What is essential in the further teaching is the basic notion that a hand engagement arrangement can be made accessible and again inaccessible by a slight movement of the closure element itself. Specifically, it is proposed that a hand engagement arrangement is provided on the closure element, which is not accessible when the closure element is in the closed position owing to the interaction of closure element and motor vehicle body and which is accessible with the engagement gap created in the gap position between closure element and motor vehicle body, especially through the engagement gap. The further teaching also produces numerous new possibilities for the design of the hand engagement arrangement as replacement for the typical outer door handle. Reference should be made to all configurations for the proposed motor vehicle lock arrangement that are suitable to explain the closure element arrangement.

In various embodiments, the hand engagement arrangement is arranged in the region of the end face 3*a* of the closure element bordering on the engagement gap. By "end face" is always meant the side of the closure element situated immediately adjacent to a surface of the motor vehicle body, especially a surface of a door frame or the like, when the closure element is in the main closed position.

Various embodiments provide a method for the operation of a proposed motor vehicle lock arrangement.

What is essential in the further teaching is the notion that in the course of an opening process of the closure element a motorized positioning process is controlled by a control arrangement, in that the closure element is moved by means of the servo drive from a closed position into the gap position and in this way an engagement gap is created between closure element and motor vehicle body. According some embodiments, the closure element is then further moved manually, such as free of the servo drive, in the opening direction of the closure element. Such a semiautomatic opening process is easy to implement in terms of design, yet it provides a high degree of comfort of use.

In various embodiments, the positioning process is preceded by a lifting of the locking pawl, especially by means of an auxiliary opening drive unit. In this way, it is easily possible to use a motorized movement of the latch bolt for the implementing of the positioning process, as mentioned above. Reference should be made to all configurations for the functioning of the motor vehicle lock arrangement.

An embodiment provides a motor vehicle lock arrangement for a closure element which is movably coupled to a motor vehicle body, wherein a motor vehicle lock is provided, which in the mounted state is arranged on the closure element or on the motor vehicle body, wherein the motor vehicle lock arrangement, especially the motor vehicle lock, comprises a servo drive for exerting a driving force on the closure element in its opening direction, so that the closure element can be moved in a motorized positioning process from a closed position into a gap position, and in this way an engagement gap can be created between closure element and motor vehicle body.

In various embodiments, the closure element, after the motorized positioning process, can be further moved manually, free of the servo drive, in the opening direction of the closure element.

In various embodiments, a hand engagement arrangement on the closure element is accessible from the outside through the engagement gap, and/or in that a handle of a hand engagement arrangement can be moved outwardly through the engagement gap.

In various embodiments, the servo drive serves to move a component, especially a latch bolt, of the motor vehicle lock, or in that the motor vehicle lock arrangement comprises a striker or the like, which can be brought into engagement with the motor vehicle lock for the transmittal of door holding forces, and in that the servo drive serves to move the striker or the like.

In various embodiments, the motor vehicle lock comprises a latch bolt, wherein the latch bolt can be brought out of an open position by a movement in the closing direction of the latch bolt into at least one closed position, especially a main closed position and a pre-closed position, in which the latch bolt engages with a striker or the like for the transmittal of door holding forces, and wherein the latch bolt can be brought out from the closed position or closed positions by a movement in the opening direction of the latch bolt into the open position, in which the latch bolt releases the striker or the like in the opening direction of the closure element, wherein the latch bolt can be moved by means of the servo drive in the positioning process for creating the gap position of the closure element under motor power in the opening direction of the latch bolt into a gap position of the latch bolt, and further in that a locking pawl is provided, which can be brought into a locked position, in which it locks the latch bolt in the closed position or in at least one of the closed positions, and which can be brought into a release position in which it releases the latch bolt in the opening direction of the latch bolt.

In various embodiments, the closure element can be moved in motorized manner by means of the servo drive in a pulling shut process in the closing direction, so that the closure element is taken from a pre-closed position into a main closed position, and further in that the pre-closed position of the closure element lies between the main closed position and the gap position of the closure element.

In various embodiments, the latch bolt can be moved by means of the servo drive in a pulling shut process in motorized manner in a closing direction of the latch bolt so that the latch bolt pulls the closure element via the striker or the like into the main closed position of the closure element.

In various embodiments, the latch bolt can be moved by means of the servo drive in the positioning process in motorized manner in the opening direction of the latch bolt so that the latch bolt pushes the closure element via the striker or the like into the gap position of the closure element.

In various embodiments, the open position of the latch bolt lies between the closed position or closed positions of the latch bolt on the one hand and the gap position of the latch bolt on the other hand.

In various embodiments, the latch bolt stands or can be brought into engagement unidirectionally with the striker or the like between its open position and its gap position such that a driving force of the latch bolt on the striker or the like can be exerted only in the opening direction of the closure element by means of the servo dive.

In various embodiments, the latch bolt can be moved bidirectionally by means of the servo drive.

In various embodiments, the latch bolt comprises an inlet opening for the striker or the like and in that the latch bolt pushes the striker or the like during the positioning process in the opening direction of the closure element, especially out from the inlet opening.

In various embodiments, a control arrangement is provided, by means of which an opening process of the closure element can be controlled, and in that by means of the control arrangement in the course of an opening process a motorized positioning process can be controlled in that the closure element is moved by means of the servo drive from a closed position into the gap position and in this way a engagement gap is created between closure element and motor vehicle body, and in that the closure element, after the motorized positioning process, can be further moved manually in the opening direction of the closure element.

An embodiment provides a closure element arrangement with a closure element, which can be movably coupled to a motor vehicle body, and with a motor vehicle lock arrangement associated with the closure element as described herein, wherein a hand engagement arrangement is provided on the closure element, which is not accessible when the closure element is in a closed position owing to the interaction of closure element and motor vehicle body and which is accessible especially through the engagement gap when the closure element is in the gap position.

In various embodiments, the hand engagement arrangement is arranged in the region of the end face of the closure element bordering on the engagement gap.

In various embodiments, the hand engagement arrangement comprises a handle, which can be moved outward through the engagement gap.

An embodiment provides a method for the operation of a motor vehicle lock arrangement as described herein, wherein a control arrangement is provided, by means of which an opening process of the closure element can be controlled, and in that by means of the control arrangement in the course of an opening process a motorized positioning process is controlled in that the closure element is moved by means of the servo drive from a closed position into the gap position and in this way an engagement gap is created between closure element and motor vehicle body.

In various embodiments, the closure element, after the motorized positioning process, is further moved manually in the opening direction of the closure element.

In various embodiments, the locking pawl is lifted, especially by means of an auxiliary opening drive unit, and the closure element is then moved by means of the servo drive in the motorized positioning process from a closed position into the gap position.

BRIEF DESCRIPTION OF THE FIGURES

In the following, the invention will be explained more closely with the aid of a drawing showing only exemplary embodiments. In the drawing.

DETAILED DESCRIPTION

Figure 1:
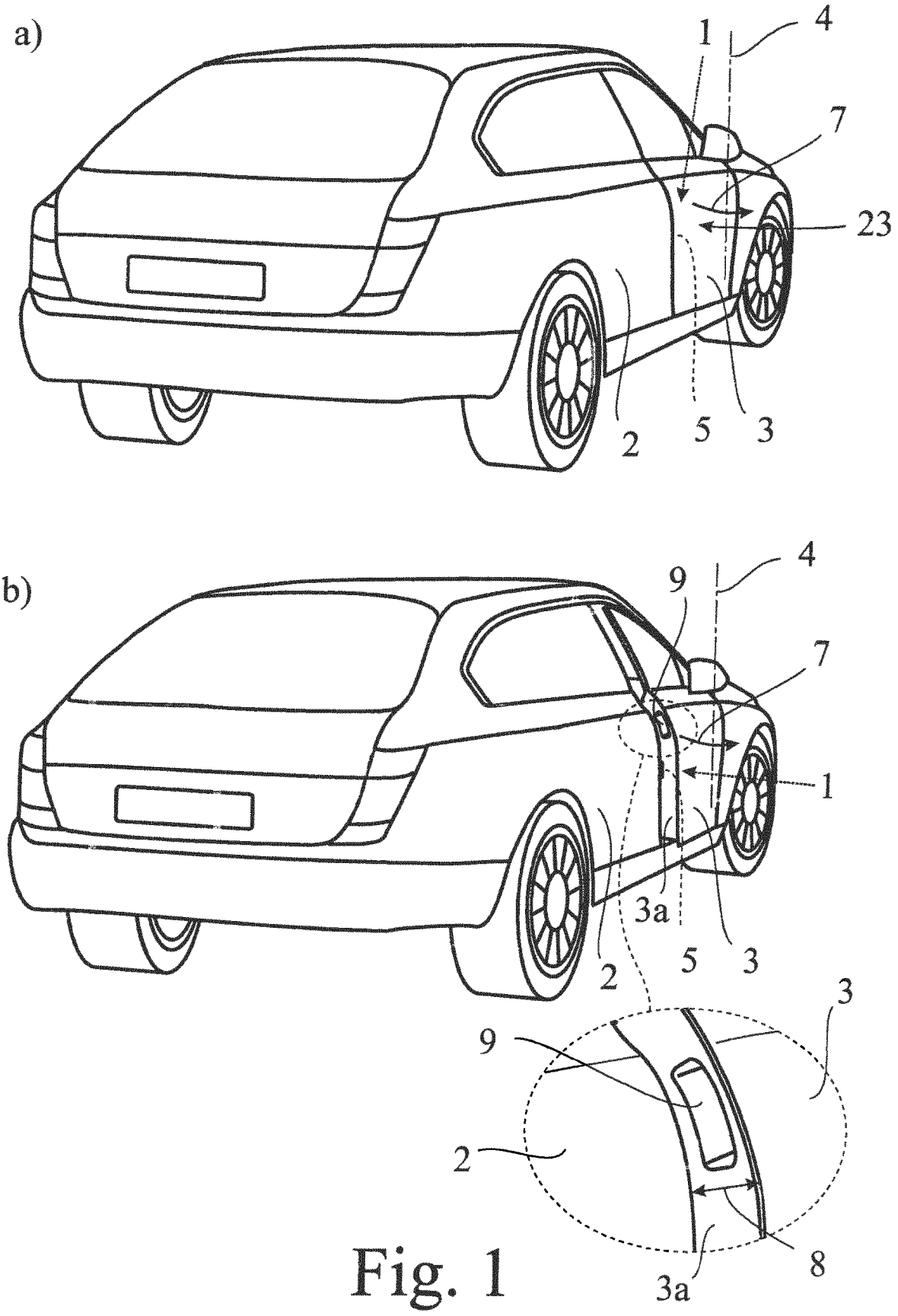
FIG. 1 shows a motor vehicle with a proposed closure element arrangement, which is fitted with a proposed motor vehicle lock arrangement, a) with the closure element in the main closed position and b) with the closure element in the gap position.

It should first be pointed out that the drawing only represents the components of the proposed motor vehicle lock arrangement that are necessary to explain the teaching.

The proposed motor vehicle lock arrangement 1 is associated with a closure element 3 which is movably coupled to a motor vehicle body 2. The closure element 3 here is a side door of a motor vehicle. However, the proposed motor vehicle lock arrangement 1 can also be used with all other conceivable closure elements of a motor vehicle. This includes, in particular, rear doors, tailgates, trunk hatches or engine hoods.

Here the closure element 3 configured as a side door can pivot about a substantially vertically oriented pivot axis 4. Basically, however, the closure element 3 can also be designed in the manner of a sliding door.

The motor vehicle lock arrangement 1 comprises a motor vehicle lock 5, which in the mounted state can be arranged on the closure element 3. Alternatively, it can also be provided that the motor vehicle lock 5 is arranged on the motor vehicle body 2.

Figure 2:
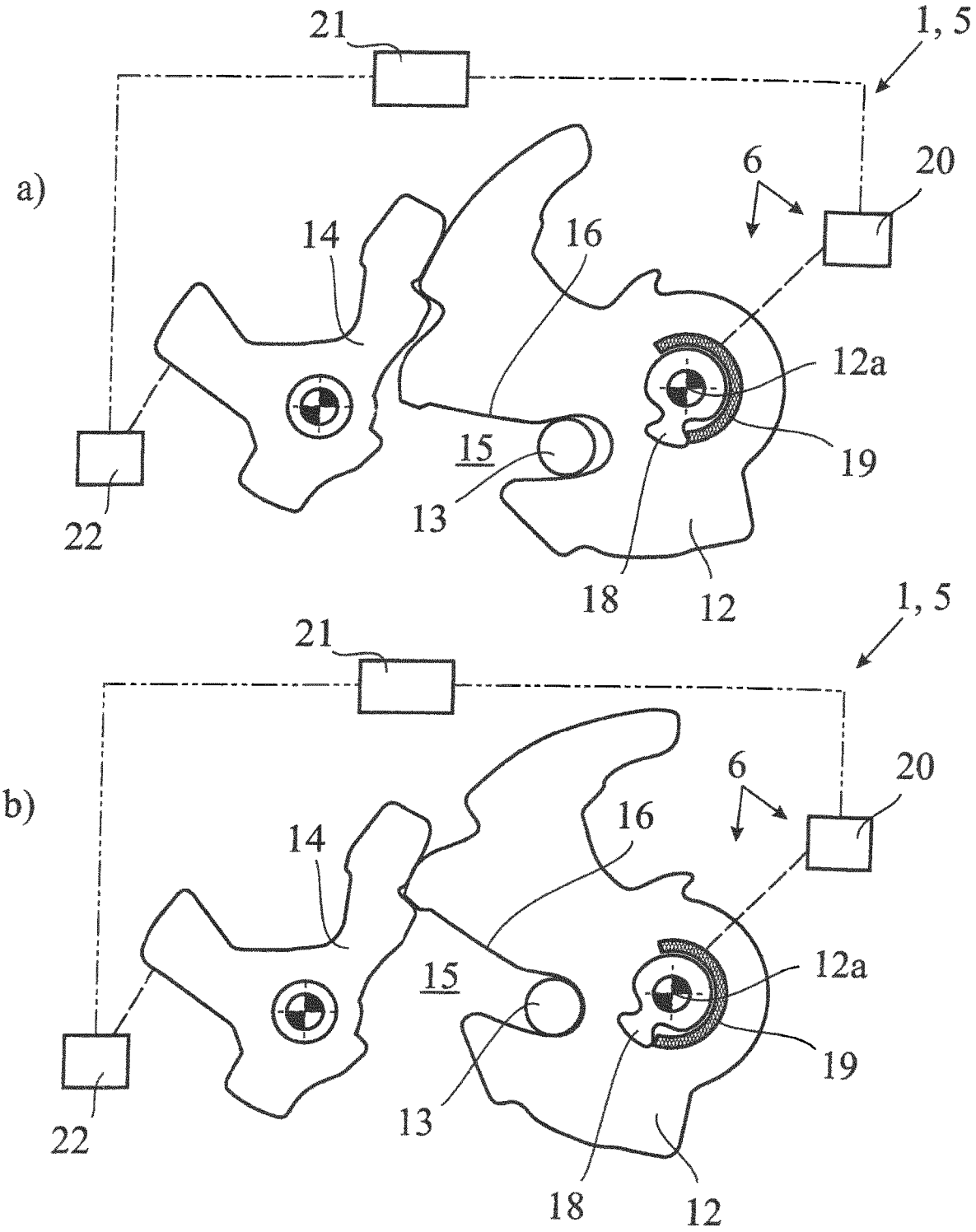
FIG. 2 shows the closing elements of the proposed motor vehicle lock arrangement a) with the latch bolt in the pre-closed position and b) with the latch bolt in the main closed position.
Figure 3:
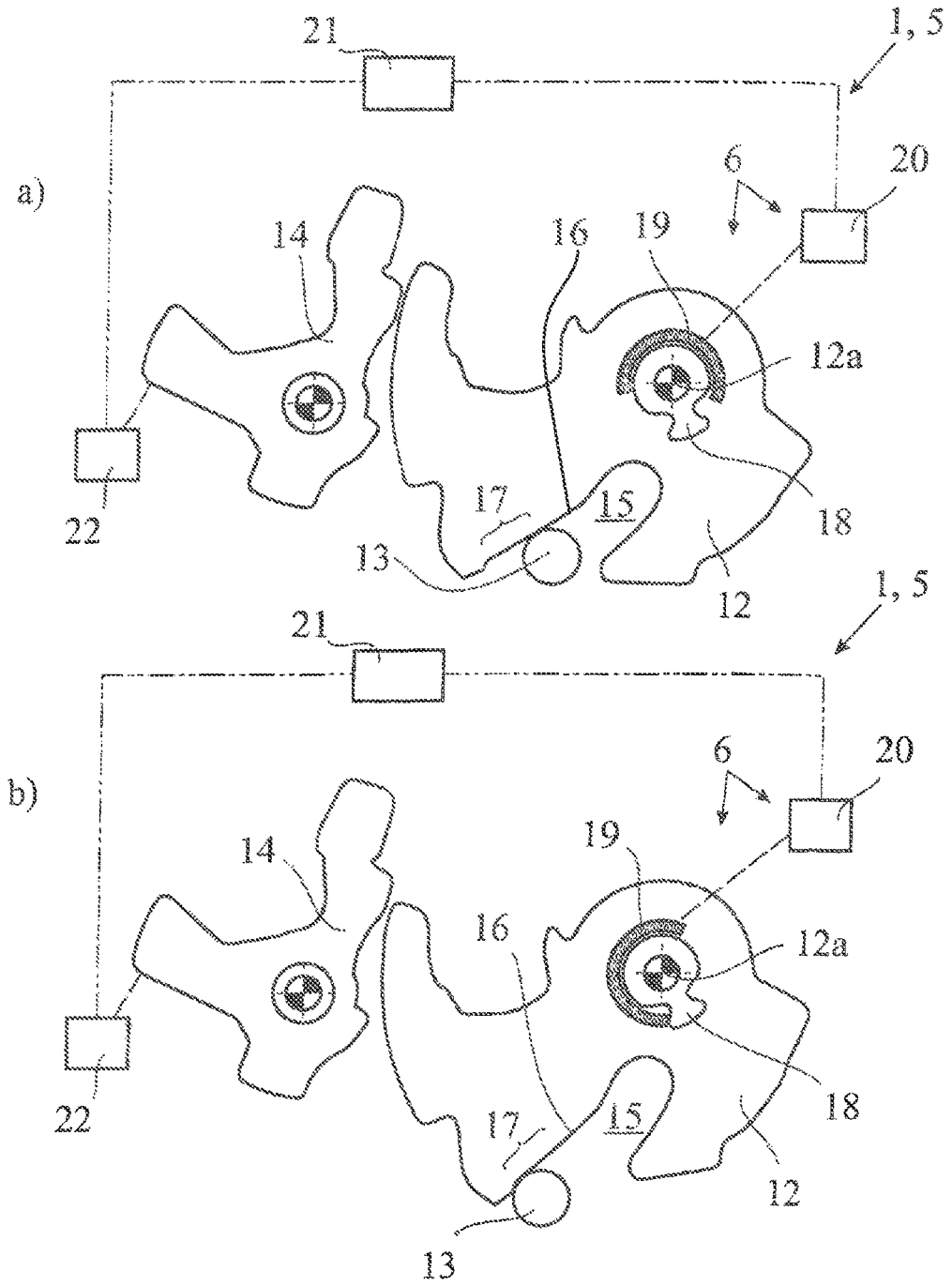
FIG. 3 shows the closing elements of a proposed motor vehicle lock arrangement a) with the latch bolt in the open position and b) with the latch bolt in the gap position.

The motor vehicle lock arrangement 1, here the motor vehicle lock 5, comprises a servo drive 6, which is only indicated in FIGS. 2 and 3. The servo drive 6 serves to exert a driving force on the closure element 3 in its opening direction 7. In other words, the servo drive 6 in the mounted state of the motor vehicle lock arrangement 1 pushes on the closure element 3 in its opening direction 7. In this way, the closure element 3 can be moved by means of the servo drive 6 in a motorized positioning process from a closed position represented in FIG. 1*a* into a gap position represented in FIG. 1*b*, so that an engagement gap 8 can be created between closure element 3 and motor vehicle body 2. The engagement gap 8, owing to the pivoting nature of the closure element 3, extends along the opening direction 7 of the closure element 3.

The servo drive 6 here is accommodated in the lock housing of the motor vehicle lock 5, which also receives the latch bolt 12. Basically, the servo drive 6 can also be arranged outside the lock housing and moreover be coupled in particular via a Bowden cable to the motor vehicle lock 5.

Here, the closure element 3, after the motorized positioning process, can be moved manually, free from the servo drive 6, further in the opening direction 7 of the closure element 3. There is then no longer any drive coupling between the servo drive 7 and the closure element 3, especially between the latch bolt 12 and a striker 13 or the like, which shall be explained further below.

Figure 4:
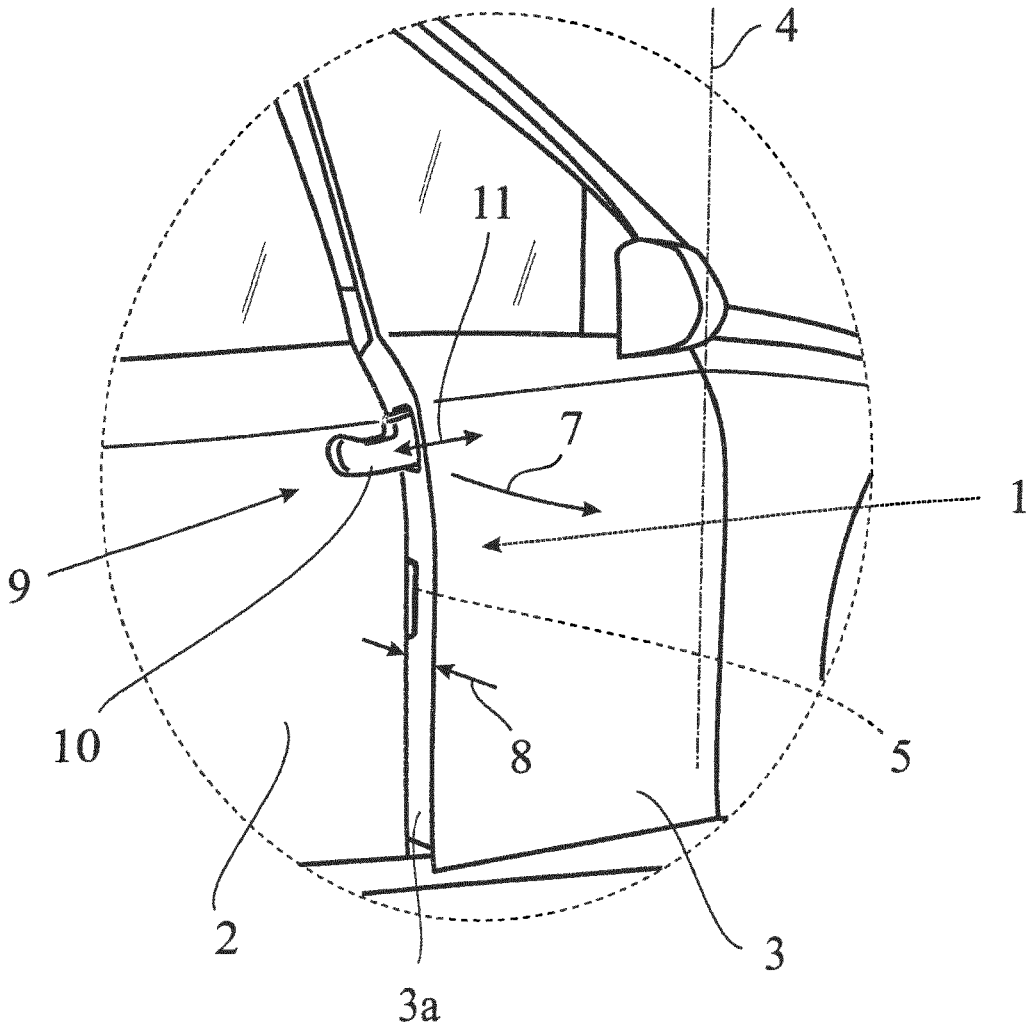
FIG. 4 shows a further embodiment of a proposed closure element arrangement with the closure element in the gap position.

In the present case, the engagement gap 8 serves to provide an engagement surface for the user's hand, in order to manually move the closure element 3. In the embodiment shown in FIG. 1, a hand engagement arrangement 9 is provided for this, which as shown in FIG. 1*b* is accessible from the outside through the engagement gap 8. Alternatively, however, it can also be provided that a handle 10 of a hand engagement arrangement 9 can be moved outwardly through the engagement gap 8, as indicated in FIG. 4. The direction of movement of the handle 10 is indicated by reference number 11 in FIG. 4.

In the exemplary embodiment represented in FIGS. 2 and 3, the servo drive 6 serves to move a component, here a latch bolt 12, of the motor vehicle lock 5, so that the aforementioned positioning process comes down to a movement of the component, namely, the latch bolt 12.

Alternatively, it can be provided that a striker 13 or the like of the motor vehicle lock arrangement 1, interacting with the latch bolt 12 and able to be brought into engagement with the motor vehicle lock 5 for the transmittal of door holding forces, can be moved by means of the servo drive 6 in order to implement the positioning process.

The motor vehicle lock 5 here is fitted, as mentioned above, with a latch bolt 12, which can be brought out of an open position shown in FIG. 3*a* by a movement in the closing direction, in FIG. 3 by a movement in the clockwise direction, into at least one closed position, here into a main closed position (FIG. 2*b*) and into a pre-closed position (FIG. 2*a*). In the closed positions, the latch bolt 12 engages with an aforementioned striker 13 or the like for the transmittal of door holding forces. The door holding forces act on the closure element 3 in its closing direction, in order to prevent an opening of the closure element 3.

On the contrary, the latch bolt 12 can be brought out from the closed positions (FIG. 2*a,b*) by a movement in the opening direction, counterclockwise in FIG. 2, into the open position (FIG. 3*a*), in which the latch bolt 12 releases the striker 13 in the opening direction 7 of the closure element 3. It is an interesting fact that the latch bolt 12 can be moved by means of the servo drive 6 in the positioning process for creating the gap position of the closure element 3 under motor power in its opening direction, counterclockwise in FIG. 3, into a corresponding gap position of the latch bolt 12 (FIG. 3*b*).

As can be seen from the representations of FIGS. 2 and 3, a locking pawl 14 associated with the latch bolt 12 is provided, which can be brought into the locked position shown in FIG. 2, in which it locks the latch bolt 12 in a closed position, in FIG. 2*a* in the pre-closed position and in FIG. 2*b* in the main closed position, to prevent a pivoting in the opening direction of the latch bolt 12. Moreover, the locking pawl 14 can be lifted, here in motorized manner, into a release position, in which it releases the latch bolt 12 in its opening direction, so that the latch bolt 12 can pivot into its open position, counterclockwise in FIG. 2 (FIG. 3*a,b*). The movement of the locking pawl 14 into the release position involves a pivoting of the locking pawl 14 in the counterclockwise direction in FIG. 2.

While the locking pawl 14 is spring-loaded against the latch bolt 12, clockwise in the drawing, the latch bolt 12, likewise spring-loaded, is forced into its open position, counterclockwise in the drawing. The spring arrangements required for this are not shown here for an easier representation.

On account of the engagement between the latch bolt 12 and the striker 13, the main closed position of the latch bolt 12 shown in FIG. 2*b* ensures that the closure element 3 stands in a corresponding main closed position as shown in FIG. 1*a*. The same holds for the latch bolt 12 located in the pre-closed position (FIG. 2*a*), which ensures that the closure element 3 stands in a corresponding pre-closed position, not shown here. Usually a gap remains, looking in the opening direction 7, between the closure element 3 and the motor vehicle body 2 of less than 10 mm, such as around 6 mm, when the latch bolt 12 is in the pre-closed position shown in FIG. 2*a*. Thus, this gap is dimensioned such that the user's hand cannot reach through it, which would entail a substantial risk of getting pinched.

In an embodiment, the closure element 3 can be moved in motorized manner by means of the servo drive 6 in a pulling shut process in the closing direction, so that the closure element 3 is taken from the aforementioned pre-closed position into the aforementioned main closed position. With this comfort function, the user only needs to move the closure element 3 into the pre-closed position for the closing process (FIG. 2*a*), and from here the servo drive 6 then moves the closure element 3 from the pre-closed position into the main closed position and takes over the relatively large door sealing pressure.

In various embodiments, the pre-closed position of the closure element 3 lies between the main closed position (FIG. 1*a*) and the gap position (FIG. 1*b*) of the closure element 3. This means that the engagement gap 8 going back to the gap position of the closure element 3 is larger than the above-mentioned gap corresponding to the pre-closed position between closure element 3 and motor vehicle body 2. In various embodiments, the gap width of the engagement gap 8 is larger than 18 mm and, in some embodiments, larger than 22 mm. In an embodiment, the gap width of the engagement gap 8 is between around 26 mm and around 31 mm. These values have been found to be especially advantageous for reaching through the engagement gap 8 with the user's hand.

Here, both the above pulling shut process and the above positioning process are based on a motorized movement of the latch bolt 12. Specifically, the latch bolt 12 can be moved by means of the servo drive 6 in the pulling shut process in motorized manner in the closing direction of the latch bolt 12 so that the latch bolt 12 pulls the closure element 3 via the striker 13 or the like into the main closed position of the closure element 3. In addition, the latch bolt 12 can be moved by means of the servo drive 6 in the positioning process in motorized manner in the opening direction of the latch bolt 12 so that the latch bolt 12 pushes the closure element 3 via the striker 13 or the like into the gap position of the closure element 3. Basically, it can also be provided that only one of the two aforementioned processes is based on a motorized movement of the latch bolt 12.

A joint viewing of FIG. 2 together with FIG. 3 shows that the open position of the latch bolt 12 (FIG. 3*a*) lies between the closed position or the closed positions of the latch bolt 12 (FIG. 2) on the one hand and the gap position of the latch bolt 12 (FIG. 3*b*) on the other hand. It becomes clear here that the latch bolt 12 for the implementing of the gap position of the closure element 3 is associated with a new position, namely, likewise a gap position as shown in FIG. 3*b*.

FIG. 3 further shows that the latch bolt 12 stands or can be brought into engagement unidirectionally with the striker 13 or the like between its open position and its gap position such that a force action of the latch bolt 12 on the striker 13 is possible only in the opening direction of the closure element 3. Specifically, by means of the servo drive 6 a driving force can be exerted solely in the opening direction of the closure element 3 by the latch bolt 12 on the striker 13 or the like. It is advantageous that there is no risk of getting pinched in this movement range of the latch bolt 12 on account of the servo drive 6.

In the embodiment represented, the latch bolt 12 can be moved in one pivoting direction for the implementing of the pulling shut process, clockwise in FIG. 3, and in the other pivoting direction for the implementing of the positioning process, counterclockwise in FIG. 2. Accordingly, the latch bolt 12 can be moved bidirectionally by means of the servo drive 6 in order to implement both processes.

In an embodiment, it is provided that the movement path of the closure element 3 is shorter during the pulling shut process than in the positioning process. It is assumed here that the pulling shut process involves a movement of the latch bolt 12 from the pre-closed position into the main closed position, while the positioning process involves a movement of the latch bolt 12 from its open position into its gap position.

The shaping of the latch bolt 12 has very special significance for the realization of the positioning process. Here, the latch bolt 12 comprises an inlet opening 15 for the striker 13, wherein the latch bolt 12 pushes the striker 13 during the positioning process in the opening direction 7 of the closure element 3. This is shown by the transition from FIG. 3*a* to FIG. 3*b*. In the embodiment represented, the latch bolt 12 is configured such that it pushes the striker 13 out from the inlet opening 15 during the positioning process. For this, a driving contour 17 adjoins an inner part of the inlet opening 15, especially a wall 16 of the inlet opening 15, and upon movement of the latch bolt 12 from the open position into the gap position comes into a driving engagement with the striker 13, pushing the striker 13 in the opening direction of the closure element 3. This type of driving of the striker 13 in the opening direction 7 of the closure element 3 is especially easy in design and thus economical to realize.

Numerous design configurations are conceivable for the servo drive 6. Here, the latch bolt 12 is fitted with a dog 18, which can be brought into driving engagement with a driving part 19 driveable in motorized manner. In the embodiment represented, the driving part 19 is configured as a cylinder segment with a cross section in the shape of a circle segment. The driving part 19 can pivot about a geometrical pivot axis 12*a*, being the geometrical pivot axis 12*a* of the latch bolt 12. The driving part 19 is associated with a drive motor 20, especially an electric one, operating here in bidirectional manner, being only suggested in the drawing. Upon a pivoting of the driving part 19, the driving part 19 engages in both driving directions with the dog 18, so that the latch bolt 12 can be pivoted by means of the servo drive 6 in both pivoting directions. Accordingly, a movement of the latch bolt 12 from the pre-closed position shown in FIG. 2*a* into the main closed position shown in FIG. 2*b* can be realized in that the driving part 19 is pivoted in motorized manner clockwise. On the contrary, a movement of the latch bolt 12 from the open position shown in FIG. 3*a* into the gap position shown in FIG. 3*b* can be accomplished by the pivoting of the driving part 19 in motorized manner counterclockwise.

An interesting fact in the configuration of dog 18 and driving part 19 is that a freewheeling is provided between these two components, so that for example a movement of the latch bolt 12 from its open position into its pre-closed position and also into its main closed position is possible, without the dog 18 acting on the driving part 19 in a driving manner. In this way, a manual shutting of the closure element 3 without influence from the servo drive 6 is possible. On the other hand, with a suitable control of the servo drive 6, it can also be ensured that a movement of the latch bolt 12 from the main closed position through the pre-closed position into the open position is done without influence from the servo drive 6. However, this is not represented in the drawing.

In various embodiments, the motor vehicle lock arrangement 1 is associated with a control arrangement 21, by means of which an opening process of the motor vehicle lock arrangement 1 can be controlled. Such an opening process can be triggered by an activation of a radio key, by a sensor arranged beneath the outer door skin, or the like.

By means of the control arrangement 21, a motorized positioning process can be controlled in the course of an opening process of the closure element 3 in that the closure element 3 is moved by means of the servo drive 6 from a closed position into the gap position and in this way an engagement gap 8 is created between closure element 3 and motor vehicle body 2, while the closure element 3, after the motorized positioning process, can be further moved manually in the opening direction of the closure element 3, especially free from the servo drive 6.

The control arrangement 21 can basically serve solely for actuating the aforementioned servo drive 6. Here, however, the locking pawl 14 is associated with its own auxiliary opening drive unit 22, which can be actuated by the control arrangement 21. In the course of an opening process it can be provided that at first the locking pawl 14 is lifted, especially by means of the auxiliary opening drive unit 22, and the closure element 3 is then moved by means of the aforementioned servo drive 6 to create a gap position of the closure element 3 in the opening direction 7 of the closure element 3 in motorized manner. The synchronization of auxiliary opening drive unit 22 and servo drive 6 has special importance here. In particular, it must be ensured that the lifting of the locking pawl 14 occurs before the starting of the servo drive 6.

Finally, it should be pointed out in respect of the first-mentioned teaching that the servo drive 6 here is an electromotor servo drive. However, it is also conceivable for the servo drive 6 to be a pneumatic, hydraulic, electromagnetic or other servo drive. Moreover, it is conceivable that the servo drive 6 can take on both the function of the motorized movement of the latch bolt 12 and the function of the motorized lifting of the locking pawl 14, which can result in a compact and economical design.

According to a further embodiment, a closure element arrangement 23 is provided with an aforementioned closure element 3, which is movably coupled to the motor vehicle body 2, and a motor vehicle lock arrangement 1 associated with the closure element 3.

According to the proposal, a hand engagement arrangement 9 is provided on the closure element 3, which is not accessible (FIG. 1*a*) when the closure element 3 is in a closed position owing to the interaction of closure element 3 and motor vehicle body 2 and which is accessible here through the engagement gap 8 (FIG. 1*b*, FIG. 4) when the closure element 3 is in the gap position. FIG. 1*a* shows that the hand engagement arrangement 9, when the closure element 3 is in the main closed position, is protected, and especially covered, by the closure element 3 on the one hand and the motor vehicle body 2 on the other hand. With a suitable design, this can even result in the hand engagement arrangement 9 being sealed off from the outside, so that the hand engagement arrangement 9 is constantly protected against dirt and wetness.

In the variant shown in FIG. 1*b* for the hand engagement arrangement 9, the hand engagement arrangement 9 is arranged in the region of the end face 3*a* of the closure element 3 bordering on the engagement gap 8. The definition of the term "end face" has already been explained above. Here, the hand engagement arrangement 9 is arranged in the region of the side of the closure element 3, designed as a side door, which faces the rear of the motor vehicle. This can be seen in FIG. 1.

In the most simple case, shown in FIG. 1*b*, the hand engagement arrangement 9 is basically a surface which the user can reach with his hand through the engagement gap 8.

Alternatively, it can also be provided that the hand engagement arrangement 9 comprises an aforementioned handle 10, which can be moved outwardly through the engagement gap 8. FIG. 4 shows that this handle 10 can be moved in the movement direction 11. For this movement, the handle 10 can be assigned its own drive unit, not represented here.

Also provided is a method for the operation of a proposed motor vehicle lock arrangement 1.

What is essential in the further teaching is that an aforementioned control arrangement 21 is provided, by means of which an opening process can be controlled. By means of the control arrangement 21 in the course of an opening process a motorized positioning process is controlled, in that the closure element 3 is moved by means of the servo drive 6 from a closed position into the gap position and in this way an engagement gap 8 is created between closure element 3 and motor vehicle body 2.

After the motorized positioning process, the closure element 3 can be further moved manually in the opening direction of the closure element 3.

In an embodiment, in the course of an opening process the locking pawl 14 is lifted, especially by means of an auxiliary opening drive unit 22 as per the above. The closure element 3 is then moved by means of the servo drive 6 in the motorized positioning process from a closed position into a gap position. In an embodiment, it can additionally be provided that an aforementioned handle 10 is then moved outwardly through the engagement gap 8. Reference should be made to all embodiments of the proposed motor vehicle lock arrangement 1.

The invention claimed is:

1. A motor vehicle lock arrangement for a closure element which is movably coupled to a motor vehicle body, comprising a motor vehicle lock, which in a mounted state is arranged on the closure element or on the motor vehicle body, wherein the motor vehicle lock arrangement comprises a servo drive for exerting a driving force on the closure element in an opening direction, so that the closure element is selectively moved in a motorized positioning process from a closed position into a gap position, and in this way an engagement gap is selectively created between the closure element and the motor vehicle body, wherein the motor vehicle lock comprises a latch bolt, wherein the latch bolt is selectively brought out of an open position by a movement in a closing direction of the latch bolt into at least one closed position, wherein the at least one closed position comprises a main closed position, in which the latch bolt engages with a striker for the transmittal of door holding forces, and wherein the latch bolt is selectively brought out from the at least one closed position by a movement in an opening direction of the latch bolt into the open position, in which the latch bolt releases the striker in the opening direction of the closure element, wherein the latch bolt is selectively moved by the servo drive in the motorized positioning process for creating the gap position of the closure element under motor power in the opening direction of the latch bolt into a gap position of the latch bolt, wherein the latch bolt is selectively moved by the servo drive in the motorized positioning process in motorized manner in the opening direction of the latch bolt so that the latch bolt pushes the closure element via the striker into the gap position of the closure element, wherein the open position of the latch bolt lies between the at least one closed position of the latch bolt on the one hand and the gap position of the latch bolt on the other hand, wherein the latch bolt comprises a driving contour for pushing the closure element into the gap position, and wherein a freewheeling is provided between the latch bolt and the servo drive such that the latch bolt is selectively moved from the open position into the at least one closed position without movement of any component of the servo drive.

2. The motor vehicle lock arrangement as claimed in claim 1, wherein the closure element, after the motorized positioning process, is selectively further moved manually, free of the servo drive, in the opening direction of the closure element.

3. The motor vehicle lock arrangement as claimed in claim 1, wherein a hand engagement arrangement on the closure element is accessible from an outside of the closure element through the engagement gap, and/or wherein a handle of a hand engagement arrangement is selectively moved outwardly through the engagement gap.

4. The motor vehicle lock arrangement as claimed in claim 1, wherein the at least one closed position of the latch bolt comprises a pre-closed position.

5. The motor vehicle lock arrangement as claimed in claim 4, further comprising a locking pawl which is selectively brought into a locked position, in which the locking pawl locks the latch bolt in the at least one closed position, and which is selectively brought into a release position in which the locking pawl releases the latch bolt in the opening direction of the latch bolt.

6. The motor vehicle lock arrangement as claimed in claim 1, wherein the closure element is selectively moved in a motorized manner by the servo drive in a pulling shut process in the closing direction, so that the closure element is taken from a pre-closed position into a main closed position.

7. The motor vehicle lock arrangement as claimed in claim 1, wherein the latch bolt is selectively moved by the servo drive in a pulling shut process in a motorized manner in the closing direction of the latch bolt so that the latch bolt pulls the closure element via the striker into the main closed position of the closure element.

8. The motor vehicle lock arrangement as claimed in claim 1, wherein the latch bolt is selectively brought into engagement unidirectionally with the striker between the open position and the gap position such that a driving force of the latch bolt on the striker is selectively exerted only in the opening direction of the closure element by the servo drive.

9. The motor vehicle lock arrangement as claimed in claim 1, wherein the latch bolt is selectively moved bidirectionally by the servo drive.

10. The motor vehicle lock arrangement as claimed in claim 1, wherein the latch bolt comprises an inlet opening for the striker and wherein the latch bolt pushes the striker during the motorized positioning process in the opening direction of the closure element, out from the inlet opening.

11. The motor vehicle lock arrangement as claimed in claim 1, wherein a control arrangement is provided, by which an opening process of the closure element is selectively controlled, and wherein by the control arrangement in the course of the opening process the motorized positioning process is selectively controlled in that the closure element is moved by the servo drive from the closed position into the gap position and in this way the engagement gap is created between the closure element and the motor vehicle body, and wherein the closure element, after the motorized positioning process, is selectively further moved manually in the opening direction of the closure element.

12. A closure element arrangement comprising a closure element, which is selectively movably coupled to a motor vehicle body, and with a motor vehicle lock arrangement associated with the closure element as claimed in claim 1, a hand engagement arrangement is provided on the closure element, which is not accessible when the closure element is in the closed position owing to the interaction of the closure element and the motor vehicle body and which is accessible through the engagement gap when the closure element is in the gap position.

13. The closure element arrangement as claimed in claim 12, wherein the hand engagement arrangement is arranged in the region of an end face of the closure element bordering on the engagement gap.

14. The closure element arrangement as claimed in claim 12, wherein the hand engagement arrangement comprises a handle, which is selectively moved outward through the engagement gap.

15. A method for the operation of a motor vehicle lock arrangement as claimed in claim 1, comprising a control arrangement, by which an opening process of the closure element is selectively controlled, and wherein by the control arrangement in the course of the opening process the motorized positioning process is controlled in that the closure element is moved by the servo drive from the closed position into the gap position and in this way the engagement gap is created between the closure element and the motor vehicle body.

16. The method as claimed in claim 15, wherein the closure element, after the motorized positioning process, is further moved manually in the opening direction of the closure element.

17. The method as claimed in claim 15, wherein a locking pawl is lifted, by an auxiliary opening drive unit, and the closure element is then moved by the servo drive in the motorized positioning process from the closed position into the gap position.

* * * * *